US006997124B2

(12) United States Patent
Kim

(10) Patent No.: US 6,997,124 B2
(45) Date of Patent: Feb. 14, 2006

(54) DEVICE FOR GENERATING A LOOP OR FILE IN THE EMBROIDERY FRAME AND AN EMBROIDERY FRAME EMPLOYING THE SAME

(76) Inventor: Chung-Sik Kim, Jangan-dong 342-8 (9/7), Dongdaemoon-gu, Seoul (KR)

( * ) Notice: Subject to any disclaimer, the term of this patent is extended or adjusted under 35 U.S.C. 154(b) by 177 days.

(21) Appl. No.: 10/757,592

(22) Filed: Jan. 15, 2004

(65) Prior Publication Data

US 2004/0154503 A1 Aug. 12, 2004

(30) Foreign Application Priority Data

Jan. 15, 2003 (KR) ..... 10-2003-0002765

(51) Int. Cl.
*D05B 53/00* (2006.01)

(52) U.S. Cl. ..... 112/100; 112/220; 112/302

(58) Field of Classification Search ..... 112/99, 112/98, 100, 80.5, 80.52, 220, 187, 199, 201, 112/236, 241, 116, 439, 475.18, 475.23
See application file for complete search history.

(56) References Cited

U.S. PATENT DOCUMENTS 2,321,747 A * 6/1943 Hickey ..... 112/162
2,363,807 A * 11/1944 Rubel ..... 112/220
3,753,410 A * 8/1973 Kostenowczyk ..... 112/199
4,244,312 A * 1/1981 Bialy ..... 112/235
4,438,713 A * 3/1984 Kato ..... 112/100
5,829,373 A * 11/1998 Baxter ..... 112/176
6,109,195 A * 8/2000 Inagaki et al. ..... 112/470.01
2002/0189516 A1 12/2002 Kouichi

FOREIGN PATENT DOCUMENTS

GB 894699 4/1962

* cited by examiner

*Primary Examiner*—Ismael Izaguirre
(74) *Attorney, Agent, or Firm*—Connolly, Bove, Lodge & Hutz LLP

(57) ABSTRACT

The present invention provides a device for generating a loop or a file used in an embroidery frame and the device comprises a fore-back driving part including a fore-back driving motor, a first gear driven with said motor, a second gear driven by a means coupling with said first gear, a third gear driven by a co-axis of rotation with said second gear, a first stop bar to switch said motor positioned at the lower part of said co-axis and cam-shaped stoppers placed within the area covered by the rotation of said first stop bar; a left-right driving part including a left-right rotating motor, a fourth gear driven with said motor, and a shaft having a fifth gear associated with said forth gear at the one end and a worm gear at the other; and a lead arm part connect to said shaft and including a lead arm to generate a loop, a lead arm body to joint said lead arm, lever stoppers to suppress the rotation of the motor and a second stop bars placed with the area covered by the rotation of the lead arm wherein said each second stop bar is formed at the opposed position against each other.

5 Claims, 7 Drawing Sheets

DEVICE FOR GENERATING A LOOP OR FILE IN THE EMBROIDERY FRAME AND AN EMBROIDERY FRAME EMPLOYING THE SAME

FIELD OF THE INVENTION

This invention relates to a device for generating a loop in the embroidery frame, and more particularly to a device for generating a loop or file which enables the size of loop to be adjusted with exchange of a plurality of lead arms having various sizes by means of making at least one device attached to one side or rear side of the needle with constant angle to enable the device to generate the loop for a stereo-shaped embroidery on a textile.

BACKGROUND OF THE INVENTION

In general, the embroidery frame is known as a device to embroider a pattern or character or the like on a textile using various colors of threads. Presently, with the development of the mass production system, the manufacture of the embroidery is wholly made using an automatic embroidery frame in accordance with the various pattern designs of producers, and the automatic embroidery frame is implemented by a programmed method. But the embroidery produced with the conventional frame is patterned only in a flat form. Therefore, the frame has a disadvantage that it cannot produce some embroidery with stereo-forms and consequently cannot fully satisfy the consumers who have various desires.

A sewing machine including a device for the control of a needle thread in the formation of thread loops is known in GB 894,699. This reference is concerned with sewing machine including a device for the control of a needle thread in the formation of thread loops for loop-taker, characterized by a thread deflection member moving with the needle bar and automatically caused by its inertia to form a deflection loop in the thread as the needle bar is accelerating upwards and to relieve the thread as the needle bar is accelerating downwards. The said loop-taker cannot also prevent some thread breakage for the tensile force of thread when the needle bar is accelerating upwards and create the file in textile.

SUMMARY OF THE INVENTION

Therefore to overcome the above disadvantage, it is an object of the present invention to provide at least one device for generating a loop in the embroidery frame to embody an embroidery product in a stereo-shape, in which said at least one device can be placed at one side or rear side of a needle.

It is another object of the present invention to provide a means to protect a needle in occurrence of interference between the lead arm the device for generating the loop in the embroidery frame and the needle.

It is still another object of the present invention to provide a means to adjust the length of a loop generated by said device.

It is a further object of the present invention to provide a means to form a file by means of cutting the end of the loop generated by said device if necessary.

To achieve the above objects, in accordance with the device for generating a loop or file in the embroidery frame of the present invention, there are provided a fore-back driving part comprising a fore-back driving motor, a first gear driven said motor, a second gear driven with a coupling means, a third gear placed in a rotational axis arranged coaxially with said second gear and driven with said axis, a worm gear coupled with said third gear and converting a rotational force to a force to drive in front and in the rear, a first stop bar attached the lower of the rotation axis to switch said motor in lower part of said rotational axis and cam-shaped stoppers placed within the area covered with the rotation of said first stop bar; a left-right driving part comprising a left-right rotation motor, a fourth gear driven by said motor, a shaft having a fifth gear coupled with said fourth gear at one end and having a worm gear at the other end; and a lead arm part connected to said shaft and comprising a lead arm to generate a loop, a lead arm body joining said lead arm and driving it, a second stop bar to suppress the rotation of the motor, and lever stoppers installed both at left and right side and placed within the area covered by the rotation of said lead arm.

And the lead arms may form a set in which each lead arm has different space and said each lead arm is attached separable to the lead arm body, hence there is provided a controller to regulate the size of the loop in accordance with the space of the lead arm if required.

And also, the present invention provides a device further comprising a cutter placed at the end of the lead arm to form a file by means of cutting the loop.

And also, the present invention provides a device made from material having lower hardness than the needle.

In addition, the present invention provides an embroidery frame having at least one device for generating a loop or file described previously and multiple needles.

DETAILED DESCRIPTION OF THE PRESENT INVENTION

Figure 1:
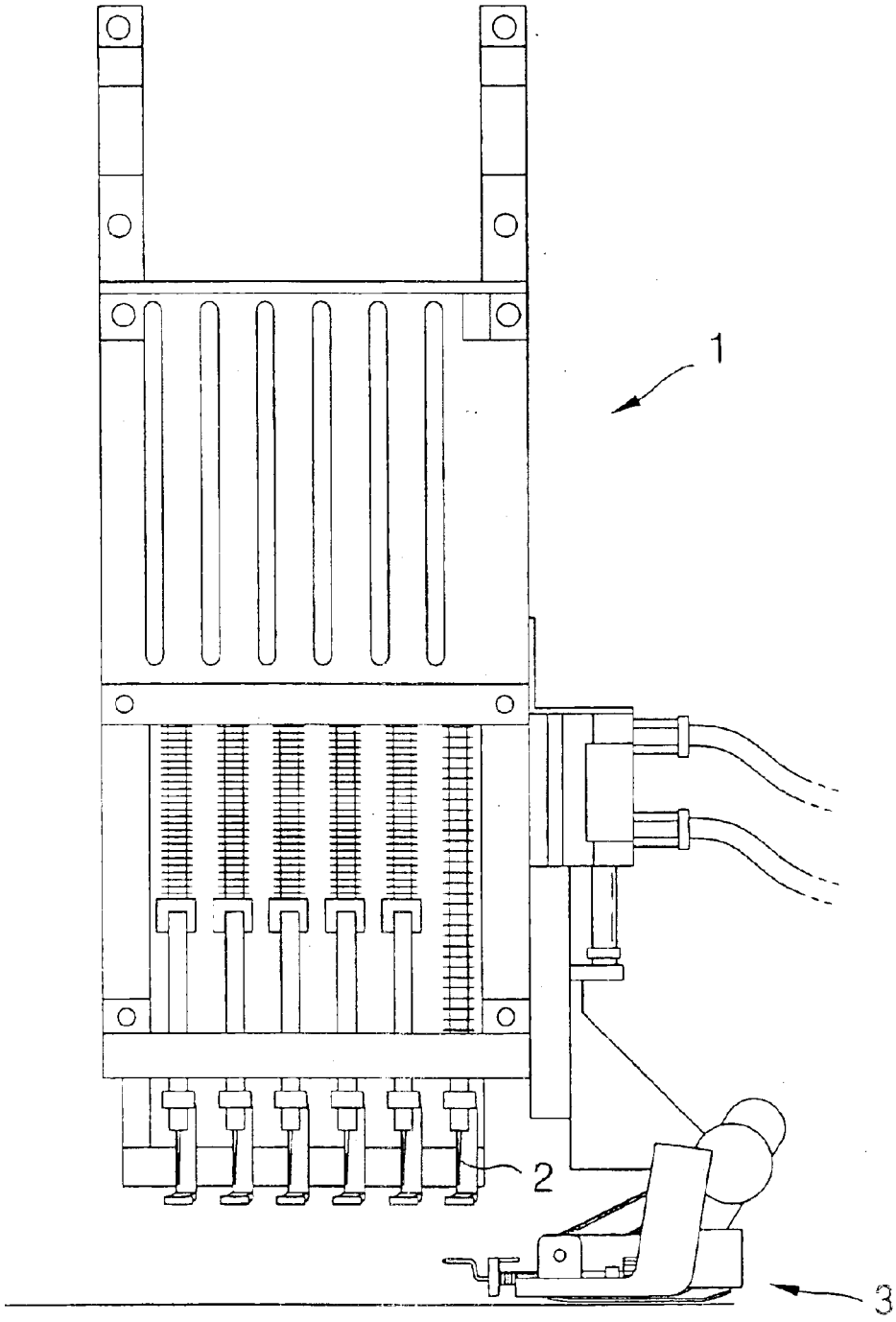
FIG. 1 is a schematic illustration in use according to one exemplary embodiment of the present invention.

In the description of the invention below, an embodiment is disclosed with reference to attached drawings. In regard to drawings, an identical element bears identical reference numeral and the well-known details of configuration will be omitted for clarity of the description.

With reference to FIG. 1 showing a device for generating a loop in use as a preferable embodiment according to the present invention viewed from one side of the embroidery frame 1, the device 3 is attached to the embroidery frame 1.

The loop generated by said device means a structure for embroidering with needle using the frame, and the loop can be generated through following steps: a lead arm moves forward and hangs the thread for embroidering; lead arm rotates with the thread hanged; and a loop formed through said rotation is embroidered with needle on the textile. A plurality of devices for generating the loop can be installed in a conventional embroidery frame as required. Also, said devices can be placed at the rear side of the frame in the direction with acute angle or at right angle. And also, the device can be easily attached to the conventional frame using the connecting means.

Figure 2:
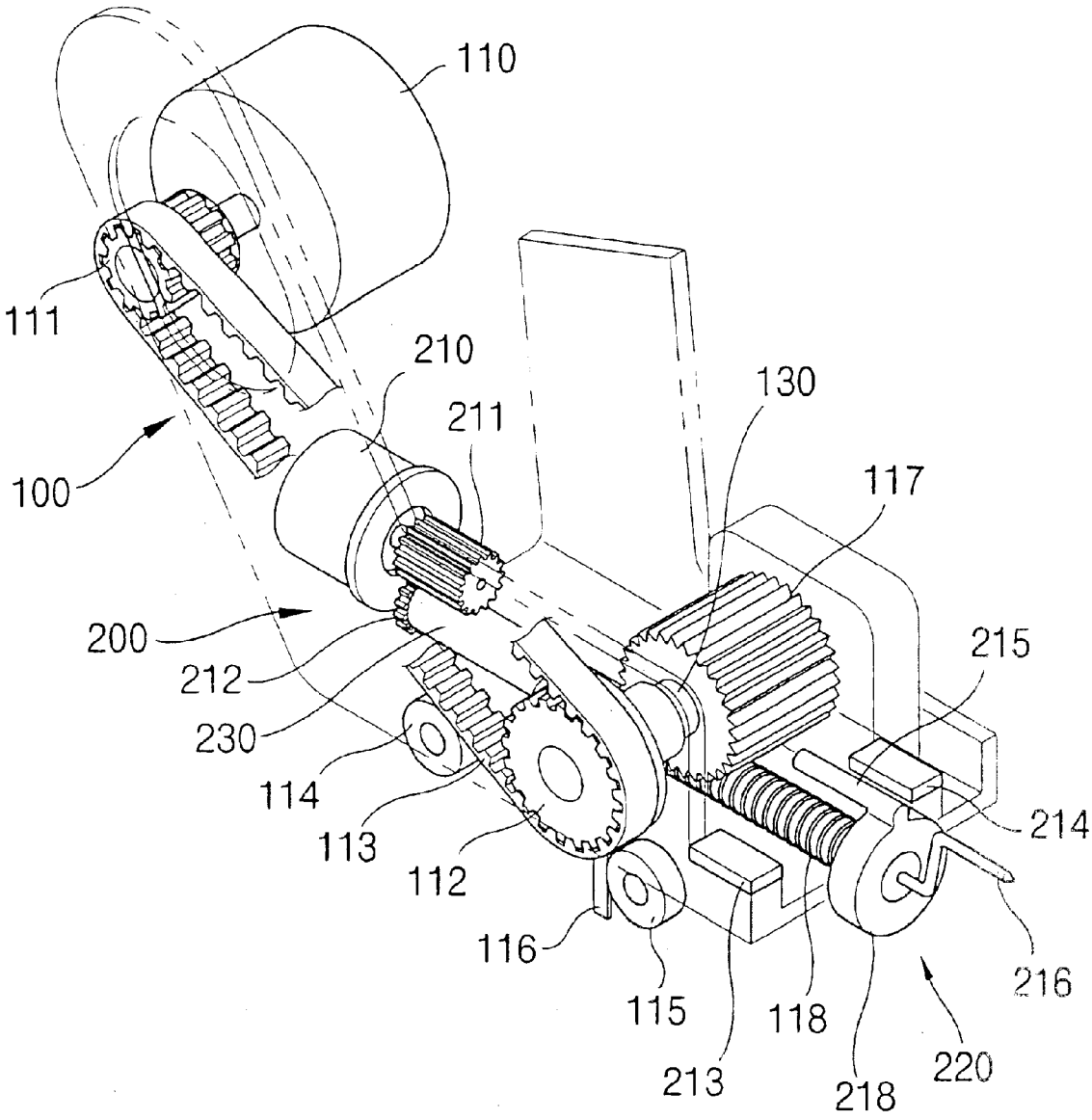
FIG. 2 is a perspective structure of a device for generating a loop in the embroidery frame in accordance with one embodiment of the present invention.

FIG. 2 is a perspective diagram to show the structure of the device for generating a loop in accordance with one preferable embodiment of the present invention. As shown in FIG. 2, the device for generating a loop in accordance with the present invention comprises a lead arm 216 to generate the loop wherein a lead part 220 with a lead arm body 218 fixing the lead arm 216. And also, the device comprises a fore-back driving part 100 to drive said lead arm 216 in front and in the rear and a left-right driving part 200 to rotate said lead arm 216 in left and right forming a semi-circle with constant radius. Even though not shown specifically in Figure, the above-mentioned components can be arranged and fixed at a proper position and can be attached to the conventional embroidery frame with known connecting means.

The left-right driving part 100 comprises a fore-back driving motor 110; a first gear 111 driven in front and in the rear; a second gear 112 driven in front and in the rear; a gear belt 113; cam-shaped stoppers 114, 115; a first stop bar 116; a third gear 117 driven in front and in the rear; and a worm gear 118 driven in front and in the rear. The first gear 111 is connected to a rotational axis of said motor 110 to generate a force to drive said lead arm 216 in front and in the rear, and said first gear 111 is coupled with said second gear 112 using the gear belt 113. And said third gear 117 is connected to said second gear 112 coaxially, while said worm gear 118 connected to the lead arm part 220 is coupled to said third gear 113 and moves together. The second gear 112 is associated with the second gear 117 using a rotation axis 130. And the stop bar 116 is attached to the rotation axis 130 wherein said stop bar 116 serve to stop the forward movement of the lead arm by means of suppressing the rotation of the motor when the lead arm reaches the required position. And also, a pair of cam-shaped stoppers 114, 115 is placed within the area covered by the rotation of the stop bar 116. Though not shown in Figure, the rotation axis 130 is fixed at a bracket with a groove formed thereof or with other fixing components.

The left-right driving part 200 comprises a left-right driving motor 210; a fourth gear 211 driven in left and right; and a fifth gear 212 driven in left and right. The fourth gear 211 is connected to the rotation axis of said motor 210 to generate a force to move the lead arm in left and right, the fourth gear 211 is connected to the fifth gear 212 and a shaft 230 has said fifth gear 212 at one end and the worm gear 118 to move the lead arm part 220 forward and back at the other end.

The lead arm part 220 comprises a second stop bar 215, the lead arm 216 and the lead arm body 218 to fix the lead arm 216. The second stop bar 215 is connected to the lead arm 216 with protrusion backward, and a pair of lever stoppers 213, 214 is installed within the area covered by the rotation of the stop bar.

Figure 3:
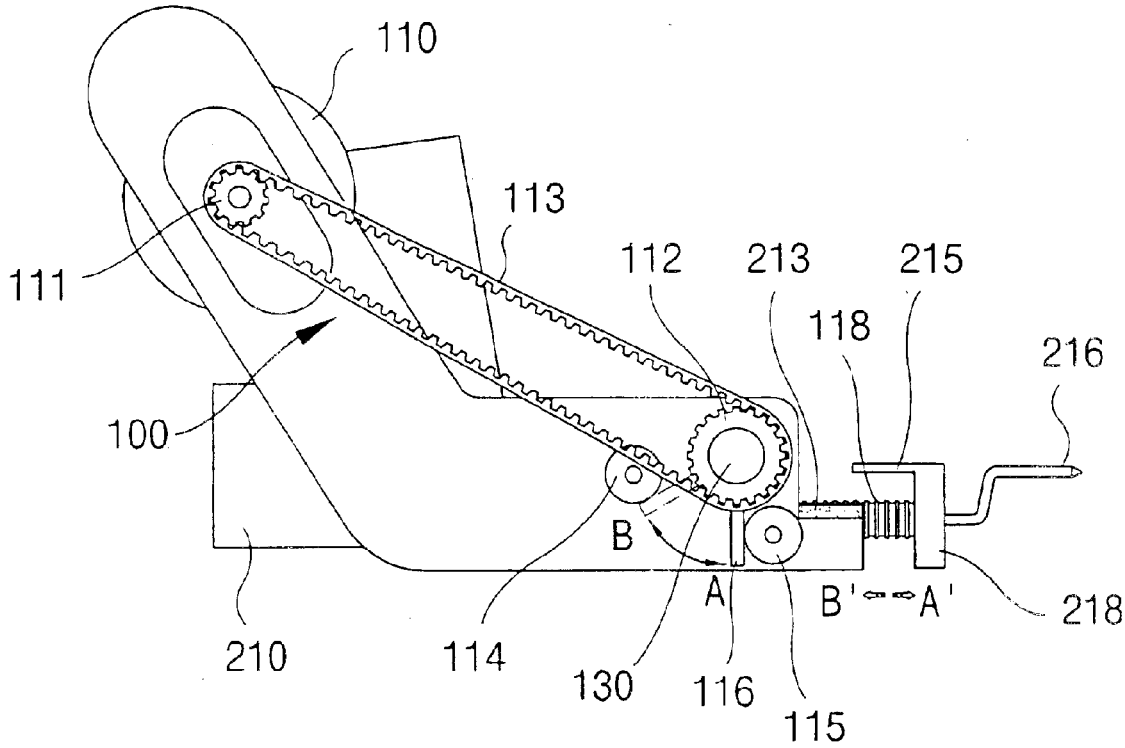
FIG. 3 is a left-side view of a device for generating a loop in the embroidery frame in accordance with one embodiment of the present invention.
Figure 4:
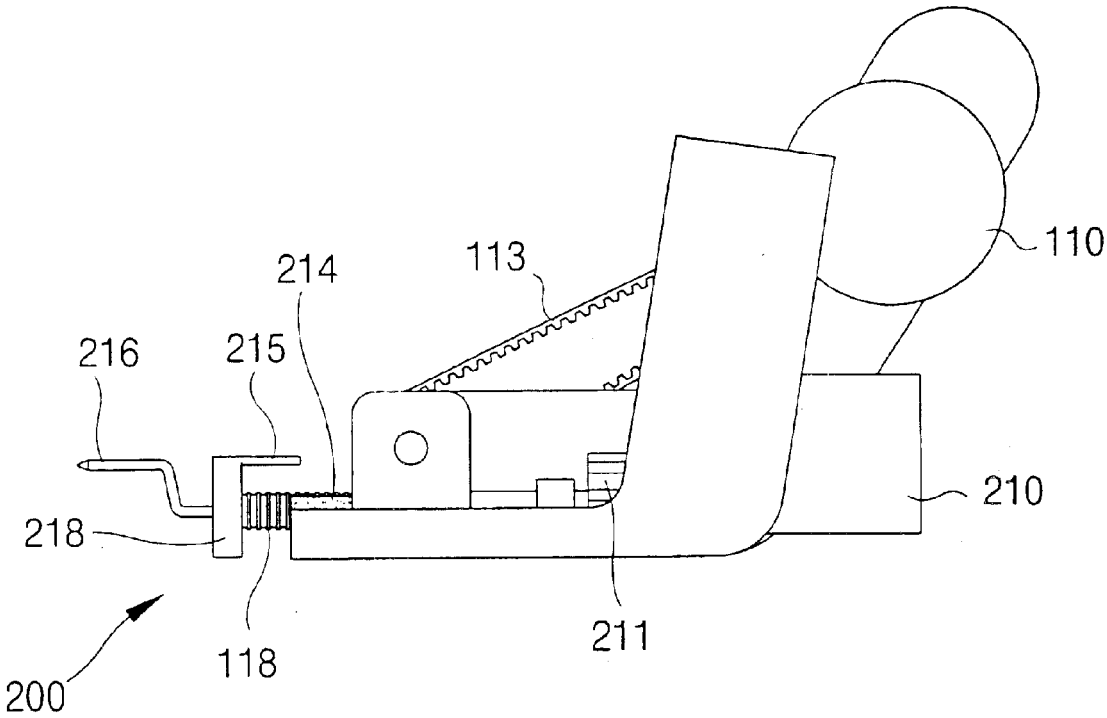
FIG. 4 is a right-side view of a device for generating a loop in the embroidery frame in accordance with one embodiment of the present invention.

FIG. 3 is a left-side view and FIG. 4 is a right-side view of a device for generating a loop in accordance with the present invention. As shown in Figures with a preferable embodiment of the present invention, the fore-back driving part 100 transfers the rotational force to the second gear 112 by means of a fore-back driving motor 110 to drive the first gear 111, and then the third gear 117 arranged in the co-axis of rotation with the second gear 112 is coupled with the second gear 112 and moves together, and finally the worm gear 118 is coupled with the third gear 117 to convert the rotational force to a driving force to move in front and in the rear. In the lower part of the co-axis of rotation 130 the first stop bar 116 and a pair of cam-shaped stoppers 114, 115 are fixed wherein said first stop bar 116 serves to switch the motor and said stoppers 114, 115 are installed within the area covered by the first stop bar 116. That is, the movement range of the drive part 100 is constrained by the cam-shaped stoppers 114, 115 placed within the area covered by the rotation of the first stop bar 116 which is installed at the rotational axis combining the second gear 112 with the third gear 117. Hence, the device of the present invention has a structure that the lead arm 216 moves forward by the distance B' to A' corresponding to that of the lead arm part 220 when the first stop bar 116 reaches the indicated A position of the cam-shaped stopper 114 and stops, while the lead arm 216 moves backward by the distance A' to B' corresponding to the that of movement of the lead arm part 220 when the first stop bar 116 reaches the indicated B position of the cam-shaped stopper 114.

And also, the left-right driving part 200 transfers the rotation force generated by the left-right driving motor 210 to the fourth gear 211. Furthermore, the left-right drive part 200 comprises a shaft 230 having the fifth gear 212 at one end thereof and a worm gear 118 on the other side, and associated with the forth gear 211. The range of left-right movement of the driving part 200 is defined a pair of lever stoppers 213, 214 wherein the lever stoppers 213, 214 is placed within the area covered by the rotation of the second stop bar 215 installed on the upper part of the lead arm part 220 and the fifth gear 212 is fixed at one end of the shaft 230, and the lead arm part 220 is fixed at the other end of the shaft 230. That is, the present invention has the structure that the second stop bar 215 is in the state of stop by one of the lever stopper and then starts to rotate in the opposed direction as required and stops again at the position of the other lever stopper installed at the opposed part. In the meanwhile, when the lead arm moves in left and right, a certain problem possibly occurs that the third gear 117 can move together with the worm gear 118 arranged in the co-axis of the rotation with the fifth gear 212. But this problem is resolved by means of selecting the third gear 117 with larger saw-tooth space compared with the shifted distance corresponding to the rotation of the worm gear 118.

Figure 5:
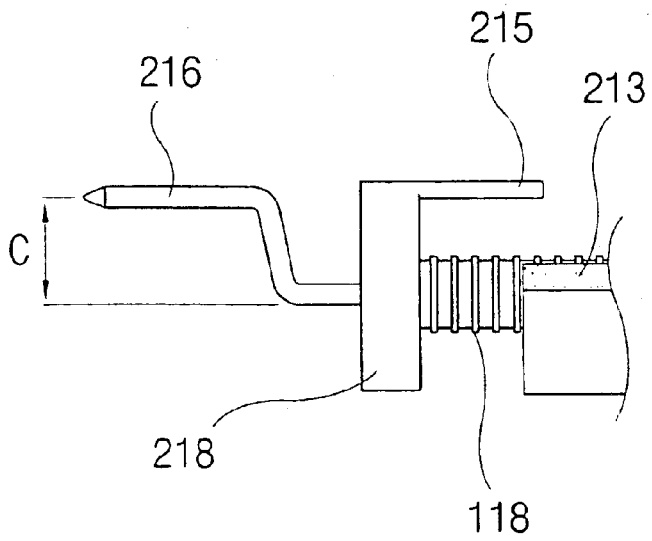
FIG. 5 is an enlarged view of a lead arm of a device for generating a loop in the embroidery frame in accordance with one embodiment of the present invention.

FIG. 5 is an enlarged view of the lead arm part 220 in accordance with one embodiment of the present invention. As shown in FIG. 5, the space of the lead arm (indicated as C) can regulate the size of loop and the space of the lead arm is adjusted by means of forming a set including more than one lead arm with different space respectively and each lead arm is secured separable at the lead arm part 220 according to the required size. And also, the material of the lead arm 216 may be selected as lower hardness than the needle such as plastics in order to be broken in case of coming upon an impact by the interference of the needle and the like. It is obvious to the skilled in the art that the shapes of both the lead arm and the cutter are not limited to those of being illustrated in the drawings, but the shapes of those can be adapted according to the various requirements.

Figure 6:
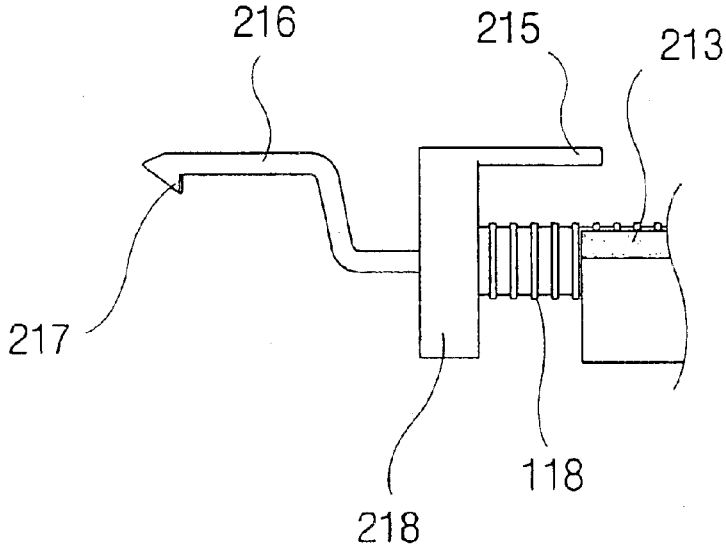
FIG. 6 is an enlarged view of a lead arm having a cutter used in a device for generating a loop of an embroidery frame in accordance with one embodiment of the present invention.

FIG. 6 is an illustration in accordance with another embodiment of the present invention to depict the lead arm part 220 comprising a lead arm 216 with a cutter 217. Referring to the embodiment illustrated in FIG. 6, at the same time that the lead arm 216 moves backward, the cutter 217 severs the end of the generated loop to form a file. That is, to form the loop the position for forming a pattern with thread, located at the lowest of the needle, is contacted to the cutter 217 formed in the terminal of the lead arm 216 with the tension (maximum tension) on the moment that the needle is raised up, and the loop is cut off. The severed loop results in two files.

In below, the operating steps according to the present invention are described referring to FIGS. 7*a* to 7*d*.

At first, a pattern required by a producer is determined and the process to produce the pattern is programmed. An embroidery frame is implemented in accordance with the installed program. Therefore, the time on which to generate the loop, the period for generating the loop and the like are determined by the program installed in advance. For example, the number of the loop formation and the movement speed of the textile are determined by the program and a variety of embroidery products can be manufactured by the programmed method.

In the embroidering processes, if the formation of the loop is required, the device for generating the loop according to the present invention is operated. The operating steps are as followings.

Figure 7A:
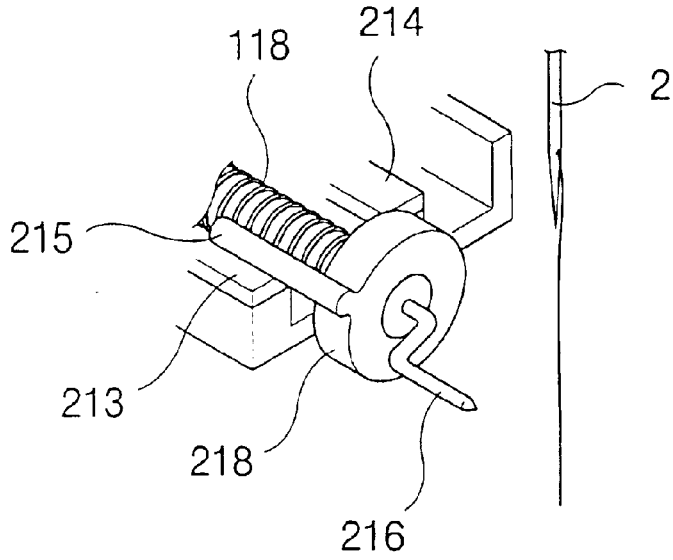
FIG. 7*a* to FIG. 7*d* presents the operating steps in accordance with the one embodiment of the present invention.

(1) As shown in FIG. 7*a*, the lead arm to constitute the device for generating the loop is halted at either of the two lever stoppers 213, 214 indicated as B' in FIG. 3, which corresponds to the state of backward movement (a step of standby).

Figure 7B:
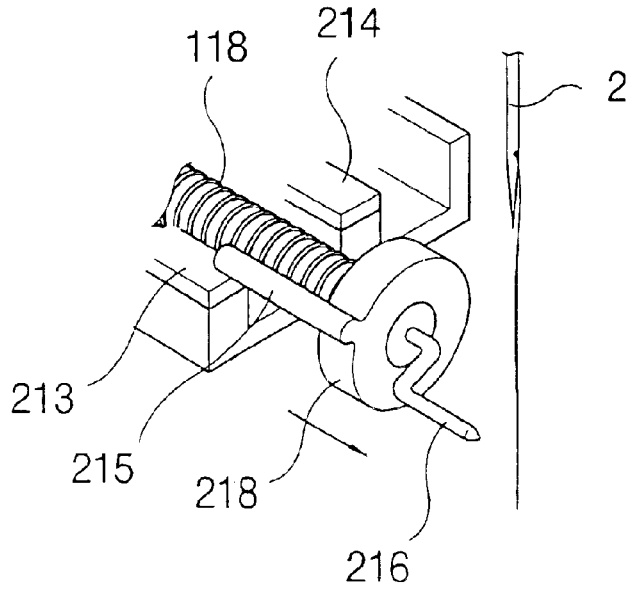

(2) As shown in FIG. 7*b*, if generating a loop is required in accordance with the program, the first gear 111 is rotated by the left-right driving motor 110 wherein the motor 110 is installed at the driving part 100 to drive the lead arm, and the first gear 111 is arranged in the co-axis of rotation with the motor 110. The rotational force is transferred to the second gear 112 through the gear belt 113. The second gear 112, then, transfers the rotational force to the third gear 113 arranged in the co-axis of rotation with the second gear 112. And the transferred rotational force is converted to the force for moving forward and backward by the worm gear 118 associated with the third gear 113, and hence the lead arm moves forward reaching the position indicated as A' in FIG. 3. In the above process, if the first stop bar 116 reaches the cam-shaped stopper 115, the lead arm 216 is halted by means of suppressing the movement of the motor 110 with the detection of overloading.

(3) In the step of (2), the needle 2 is operated more than one time while threads for embroidering are arranged between the textile and the needle holding a constant space against lead arm.

Figure 7C:
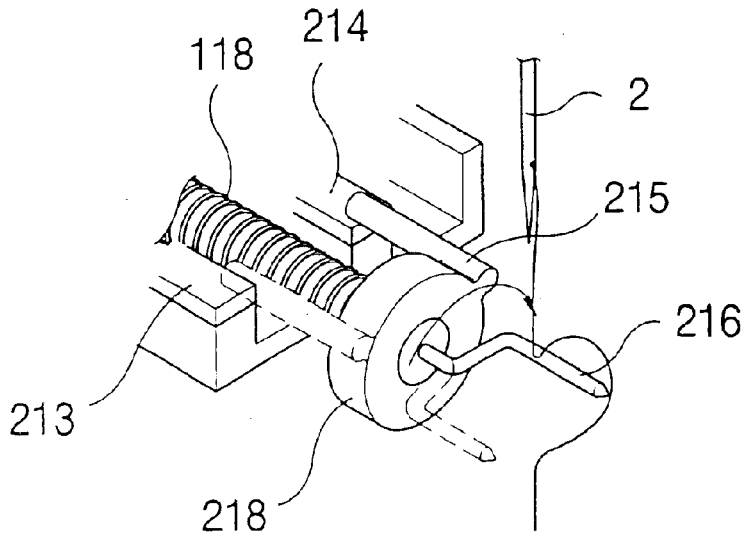

(4) As shown in FIG. 7*c*, in the step of (3), as the motor 210 installed at the left-right driving part 200 is driven, the rotational force is transferred to the fourth gear 211 coupled coaxially, and then the rotational force is transferred to the fifth gear 212. Through the transmission of the rotational force one circulation from the position at one of the two lever stoppers to the position of the other is completed, wherein the lead arm secured at the lead arm part 220 is connected to the end of the co-axis of rotation against the second gear 112 and is halted at the position of the one lever stopper before circulating (the step for generating the loop). After completing the circulation, if the second stop bar 215 installed at the lead arm part reaches one of the two lever stoppers, the operation of the motor is suppressed with the detection of overloading and, hence, the rotation of the lead arm is halted holding the state of grasping the textile at the position of the pattern embroidered.

Figure 7D:
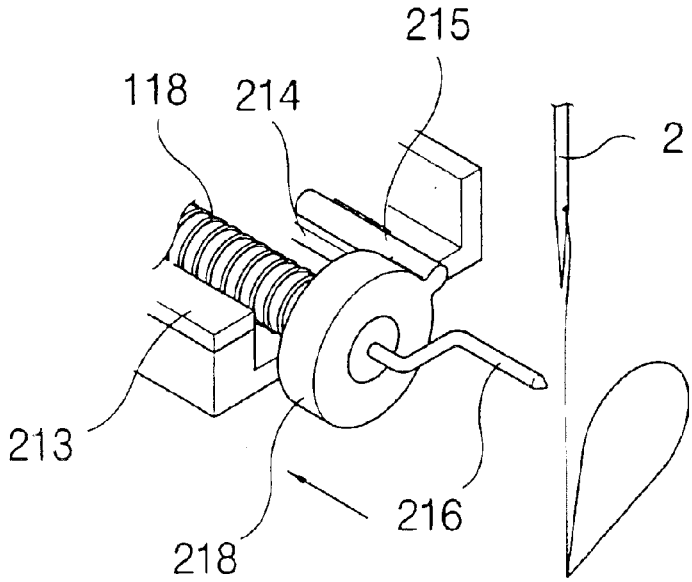

(5) As shown in FIG. 7*d*, in the step of (4), the loop is fixed on the textile with the needle operated more than one time.

(6) Even though not shown in Figures, after completing the formation of the loop, as the motor 110 is driven, the first gear 111 connected to the co-axis of rotation rotates. And the generated force through the rotation is transferred to the second gear 112 with the gear belt 113. Then the second gear transfers the rotational force to the third gear 117 connected to the co-axis of rotation. The transferred force of rotation is converted to the force for moving forward and backward by the worm gear 118 connected to the third gear. Hence, the lead arm moves backward at the position as indicated as B' in FIG. 3 and, with the first stop bar 116 reaching the cam-shaped stopper 114, the lead arm is halted and stands by as the operation of the motor is suppressed with the detection of overloading.

(7) Alternatively, a file may be formed with the severance of the end part of the loop in moving backward if a cutter is fixed at the end of the lead arm in case of need.

As described previously in detail, using the device for generating the loop in accordance with the present invention, it is feasible to provide embroidery products having stereo-patterns by means of attaching the device separable to the conventional embroidery frame. Furthermore, as a file is generated using the lead arm with the cutter, various embroidery products having many patterns can be provided to satisfy the desires of the consumer.

As another advantage of the present invention, a variety loops or/and files having different sizes respectively can be produced with exchange of the removable lead arms having different spaces each other.

As further advantage of the present invention, the breakdown of the needle due to the interference between the needle and the embroidery frame can be precluded by means of selecting the material such as a plastic to be breakable with impact.

As further advantage of the present invention, as the device for generating the loop can be attached to either side of the frame or the rear side of the frame, generating a loop is effectively implemented with appropriate selection of more than one device for generating a loop.

The present invention has been described in detail in the foregoing specification, and it is believed that various alterations and modifications of the present invention will become apparent to the skilled in the art from a reading and understanding of the specification. It is understood that all such alterations and modifications are included in the present invention insofar as they come within the scope of the appended claims.

What is claimed is:

1. A device for generating a loop or file in an embroidery frame comprising;

a fore-back driving part comprising a fore-back driving motor, a first gear driven by said motor, a second gear driven by a means coupling with said first gear, a third gear arranged in a co-axis of rotation with said second gear and moving together, a worm gear connected to said third gear and converting a rotational force to a force to move forward and backward, a first stop bar attached at a lower part of the co-axis to switch a motor and cam-shaped stoppers placed within the area covered by the rotation of said first stop bar;

a left-right driving part comprising a left-right rotating motor, a fourth gear driven with said rotating motor, and a shaft having a fifth gear at one end thereof and said worm gear at the other end; and a lead arm part connected to said shaft, and comprising a lead arm to generate a loop, a lead arm body joining said lead arm, a second stop bar to suppress the rotation of said motor, and a pair of lever stoppers placed within the area covered by the rotation of said lead arm wherein each of said lever stoppers is formed at the left and right against each other.

2. The device according to claim 1, further comprising a lead arm set that includes said lead arm and at least one additional lead arm, wherein lead arm and said at least one additional lead arm each include first and second portions that are laterally offset from each other by a space, wherein the size of said space differs between the lead arm and the at least one additional lead arm, and wherein the size of the loop is adjusted according to the size of said space.

3. The device according to claim 1, further comprising a cutter to form a file and to be positioned at the end of said lead arm.

4. The device according to claim 1, wherein said lead arm is made from a material having lower hardness than the needle.

5. An embroidery frame comprising at least one device according to claim 1.

* * * * *